US007047665B2

(12) United States Patent
Polato

(10) Patent No.: US 7,047,665 B2
(45) Date of Patent: May 23, 2006

(54) METHOD AND APPARATUS FOR DRYING INDUSTRIAL HIDES

(75) Inventor: Antonio Polato, Mussolente (IT)

(73) Assignee: Officine di Cartigliano SpA, Cartigliano (IT)

( * ) Notice: Subject to any disclaimer, the term of this patent is extended or adjusted under 35 U.S.C. 154(b) by 0 days.

(21) Appl. No.: 10/507,619

(22) PCT Filed: Mar. 18, 2003

(86) PCT No.: PCT/IB03/00947

§ 371 (c)(1),
(2), (4) Date: Sep. 20, 2004

(87) PCT Pub. No.: WO03/078663

PCT Pub. Date: Sep. 25, 2003

(65) Prior Publication Data

US 2005/0252025 A1 Nov. 17, 2005

(30) Foreign Application Priority Data

Mar. 20, 2002 (IT) ..... 2002A000050

(51) Int. Cl.
*F26B 5/14* (2006.01)
*F26B 9/04* (2006.01)

(52) U.S. Cl. ..... 34/398; 34/399; 34/70; 34/143; 34/388

(58) Field of Classification Search ..... 34/397, 34/398, 399, 400, 34, 401, 69, 70, 143, 144, 34/145, 146, 388, 164
See application file for complete search history.

(56) References Cited

U.S. PATENT DOCUMENTS 3,545,095 A * 12/1970 Dokoupil et al. ..... 34/398
4,438,570 A * 3/1984 Dokoupil ..... 34/266

FOREIGN PATENT DOCUMENTS

| | | |
|---|---|---|
| DE | 2646788 A1 * | 4/1978 |
| DE | 39 15 042 | 11/1990 |
| WO | 96/15275 | 5/1996 |
| WO | 01/44517 | 6/2001 |

* cited by examiner

*Primary Examiner*—Kenneth Rinehart
(74) *Attorney, Agent, or Firm*—Dykema Gossett PLLC

(57) ABSTRACT

A method for the Continuous gradual stretching and drying of industrial hides and similar products comprises at least one step (a) involving the initial partial drying of the completely wetted hides supplied following a treatment with liquids, such as tanning, retanning or dyeing, until their relative moisture content is reduced to between 45% and 65%, at least one step (b) involving the final stretching of the hides by means of localised mechanical stresses able to recover the shrinkage resulting from the partial drying thereof, characterized in that, after said initial partial drying step (a), at least one intermediate stretching step (c) is performed, followed by intermediate partial drying (d) followed by at least one intermediate stretching step (e) before proceeding to said step (c) involving the final drying and heat-fixing of the hides.

10 Claims, 4 Drawing Sheets

METHOD AND APPARATUS FOR DRYING INDUSTRIAL HIDES

TECHNICAL FIELD

The present invention relates in general to the technical field of tanning and concerns in particular a method for the continuous gradual stretching and drying of industrial hides and similar products, according to the preamble of Claim 1.

The invention also relates to a plant for implementing the abovementioned method, comprising all the features contained in the preamble of Claim 12.

BACKGROUND ART

It is known that certain industrial hide treatments, such as tanning, retanning and greasing, are performed in the wet, i.e. by means of immersing the hides in more or less dense water-based, oil-based or grease-based liquids, which contain chemical substances of an organic or inorganic nature and have the function of inhibiting bacterial and enzymatic processes or protecting the hides and giving them a specific aesthetic appearance.

After the abovementioned treatments, the wetted hides must be dried and stretched in order to proceed with the subsequent working steps.

It is also known that the surface area of the hides is a factor of vital importance for the cost-efficiency of a tannery, in that the price of the finished products, for the same final quality, is determined on the basis of this parameter. Therefore, one of the main objectives of tanneries is that of producing hides having the largest footage or surface area possible, in a manner which is compatible with the other qualitative demands.

In the past, in order to perform the stretching operation, traditional straight-edge blades were used, said blades requiring a large amount of effort on the part of the operators and having a limited effectiveness.

This manual operation has gradually been replaced by other automatic operations, generally called "setting out", which are performed, for example, with wringing machines having spiralled cylinders arranged opposite each other. Alternatively, the hides may be pressed and stretched by means of presses provided with pairs of felt belts which act on the hides during the feeding thereof.

Another method for stretching the hides consists in so-called "pasting", which envisages a paste being deposited on the coarse side of the wetted hides, said paste having the function of making the hides stick to glass, porcelain or metal plates. The hides treated in this way pass into a tunnel drier until they lose a significant proportion of their moisture. Once dried, the hides are separated and are in the form of flat sheets, ready for finishing and subsequent processing.

Another method of stretching the hides, known in technical jargon as "toggling", envisages the use of grippers or clamps applied along the edges of the hides and directed radially towards the outside. The clamps are secured to frames which keep the hides extended while they are passed through a tunnel drier or along a path in a controlled atmosphere. Optionally, the frames are provided with plates for supporting the hides in sections which can be separated, as described, for example, in U.S. Pat. No. 2,834,147.

A significant drawback of said known method lies in the fact that the areas affected by the grippers are put under greater stress than the central areas, in such a way that they are irreversibly damaged, giving rise to so-called "bubbles" or blisters due to the separation and creep of the fibres with respect to the skin. Moreover, the thickness of the hides is less in the gripped areas than the central areas and therefore varied stretching and reduction in thickness of the hides occurs, with consequent lower quality of the finished product.

Another known method, described in French application FR-A-2602795, envisages the use of a pair of flat plates on which respective elastically deformable mats, generally made of rubber, are placed. By compressing the hides between the mats arranged opposite each other and applying a longitudinal pulling force to the latter, stretching of the hides by means of friction is achieved. Moreover, hot air, which has the function of drying the hides, is directed between the mats. Unfortunately, the heat used for heating the hides also damages the rubber mats and therefore limits their working life. Moreover, as the working temperature cannot exceed certain maximum values, the drying time increases, reducing the efficiency of the process.

Said known stretching methods have the drawback of subjecting the hides to a mechanical stretching action which is concentrated in particular along the peripheral edge thereof. When acting on said areas, which are the thinnest areas, it is necessary to restrict the magnitude of the stresses in order to avoid breakage. This restricts the increase in the surface area and therefore the efficiency of the method.

Moreover, the stresses are not uniformly distributed and, above all, are not applied towards the centre of the hide, which has the greatest thickness and could therefore allow the greatest stretching.

British patent application GB-A-2236111 describes a method for increasing the total surface area of chrome-tanned or "wet blue" tanned hides, which envisages the moist hides being placed on a flat surface and being subjected to a simultaneous action of longitudinal traction, by means of grippers, and compression, by means of rollers displaced longitudinally with an alternating motion, which is repeated after rotation of the hides through about 90° C. This treatment allows an increase in surface area of about 10%.

However, even this solution, like the preceding solutions, does not eliminate the problem of mechanically stressing the peripheral zones of the hides and not achieving a uniform stretching thereof.

Moreover, the application of this method does not allow the fibres of the hide to be stretched in the region of its central part and therefore the liquids absorbed in this zone are retained for longer than in other zones, increasing the drying times.

A method and a line for stretching hides and other similar products is known from Italian industrial patent application No. VI2001A000220.

In this known method, the wetted hides supplied following a treatment with liquids, such as tanning, retanning, dyeing or the like, are partially dried, for example by means of setting out, and then stretched by means of localised mechanical stresses, which are applied in directions substantially perpendicular to the plane of lie of the hides so as to obtain a predetermined increase in surface area, lastly the hides are partially dried so as to stabilise and heat-fix the stretched hides. This known method is characterized in that during the stretching step, the hides are kept wet with a substantially constant level of moistness, while the mechanical stresses are exerted across the entire surface area of the hides in a substantially uniform manner, without any constraint along their peripheral edges in order to obtain a radial stretching action over their entire surface area.

This method allows the hides to be dried in a substantially uniform manner and results in products of a better quality at a relatively low cost. However, this method is discontinuous and may therefore be subject to improvement, especially for the treatment of sheep and goat hides and thin hides in general, for which it is not necessary to use a vacuum drier. Moreover, the wet stretching of the hides is performed in a single pass, not exploiting to the full the technological and qualitative potential of this process.

Lastly, the use of a vacuum drier makes it necessary to employ a certain number of operators who increase the time and cost of processing.

SUMMARY OF THE INVENTION

The object of the present invention is that of overcoming the abovementioned drawbacks by providing a method and a plant for the continuous gradual stretching of hides and similar products which allows dried products of a high quality to be obtained with extremely low processing times and production costs.

A particular object of the present invention is that of devising a method and a plant for the continuous gradual stretching of hides and similar products which allows a gradual and uniform stretching of the hides to be achieved so as to obtain hides of a substantially constant thickness and softness.

A further particular object is that of designing a plant which allows the hides to be dried gradually, stretching them gradually as they lose their moisture content, with successive stressing cycles, so as to increase the efficiency of the treatment as desired.

These objects, as well as others which will be more clearly apparent hereinafter, are achieved by a method for the continuous treatment of industrial hides and similar products which, according to Claim 1, comprises the removal and transfer of the completely wetted hides supplied following a treatment with liquids, such as tanning, retanning or dyeing, a step involving predrying the wetted hides so as to reduce their relative moisture content to a value of between 45% and 65%, at least one initial wet stretching of the hides by means of localised mechanical stresses able to recover the loss in footage and softness resulting from the predrying thereof, at least one intermediate partial drying step, at least one intermediate partial stretching and softening step followed by a final drying of the hides, a final stretching and softening of the completely dried hides, and stacking of the completely dried and softened hides on a suitable support.

According to a second aspect of the invention, a plant for implementing the method according to Claim 1 is envisaged, according to the independent claim 12.

BRIEF DESCRIPTION OF THE DRAWINGS

Further features and advantages of the invention will be more clearly understood in the light of the detailed description of some preferred but not exclusive embodiments of a method and a plant for the continuous stretching and drying of industrial hides and similar products, illustrated by way of a non-limiting example with the aid of the attached plates of drawings in which.

DETAILED DESCRIPTION OF SOME PREFERRED EMBODIMENTS

With reference to the attached drawings, a method and a plant for the continuous and gradual stretching of industrial hides and similar products according to the invention are shown.

Figure 1:
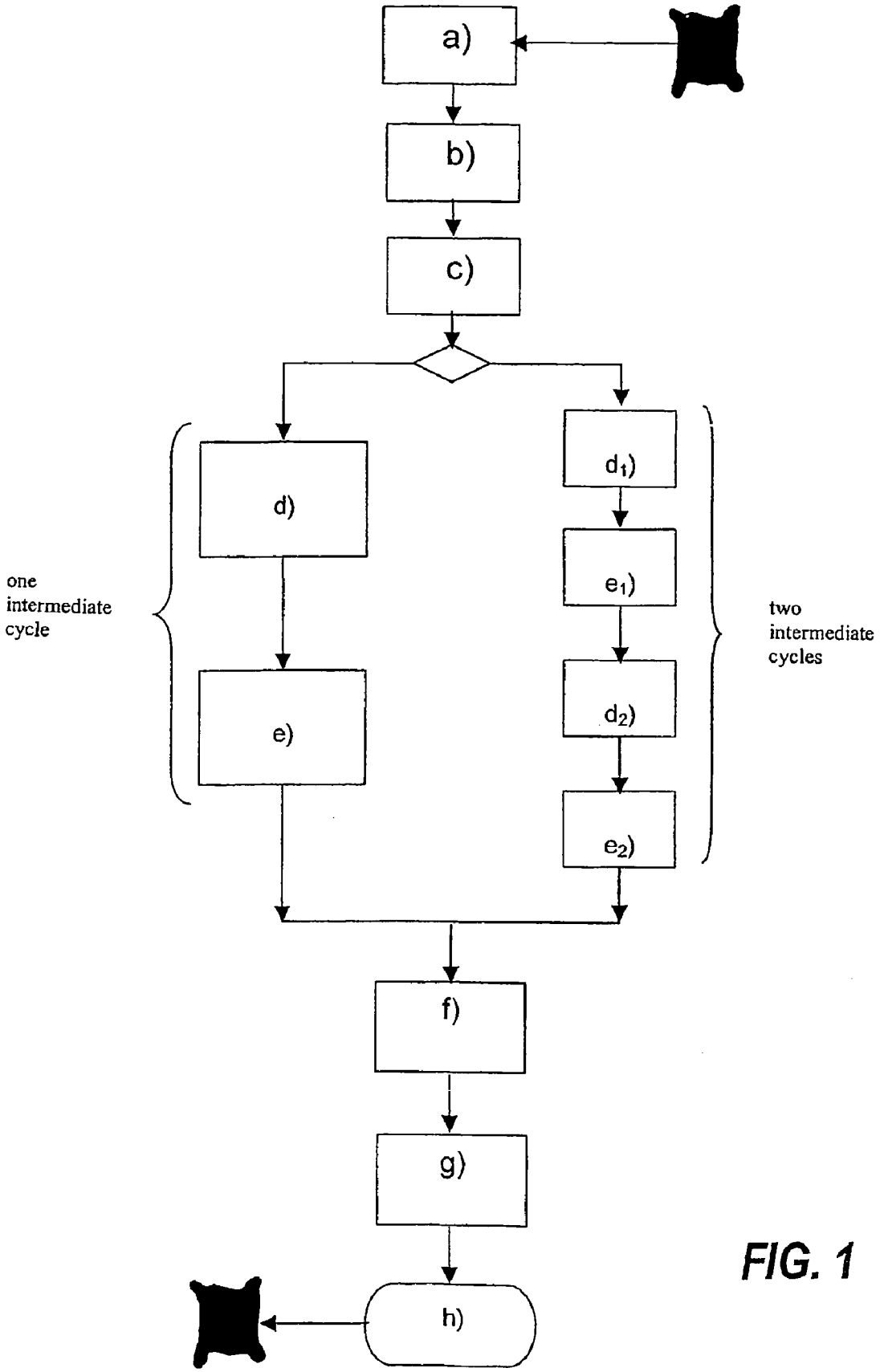
FIG. 1 shows a flow chart which illustrates the method of gradual stretching and drying of hides according to the invention.

The flow chart shown in FIG. 1 illustrates in schematic form the entire gradual stretching and drying process, with two possible operational variants, i.e. the first with a single intermediate cycle and the second with two intermediate wet stretching and partial drying cycles.

Obviously, the method may also envisage a greater number of intermediate treatment cycles without thereby departing from the scope of the invention.

The first part of the method is common to both variants and envisages a first step a) in which the hides P are removed from a tanning or retanning drum or from a dyeing or grease-dressing tank, denoted in schematic form by B, with a relative moisture content of between 85% and 100%.

In these conditions, the fibres of the hides P are particularly pliable and lend themselves to being stretched with minimal risks of breakage and local damages, significantly reducing the risk of "bubbles" and other local defects.

After being removed, the hides P are subjected to a partial predrying step b), for example using traditional pressing methods performed with a wringing or staking-out machine, essentially formed by a felt wringing/stretching press. This step is regulated in such a way that the hides have a relative residual moisture content with values of between 45% and 65%. In this step, the hides are stretched slightly or rather flattened out so that they can be easily conveyed to the next mechanical stretching step.

At this point, a step c) is envisaged, involving wet stretching of the hides P by means of localised mechanical stresses applied in directions which are substantially perpendicular to the plane of lie of the hides, according to the teachings of e.g. patent application No. VI2001A000220, so as to obtain a predetermined increase in surface area.

Conveniently, during the wet stretching step c), the hides P are kept in substantially constant relative humidity conditions, corresponding to the humidity on leaving the partial drying step b). In other words, during this step, the hides must not lose their initial moisture content so as not to lose their pliability when wet.

In addition to this, it is important that the mechanical stresses are distributed over the entire surface area of the individual hides in a substantially uniform manner. It is equally important that the hides are mechanically stressed without applying any constraints, i.e. without any gripper or clamp near their peripheral zones, so as to leave the hides free to stretch radially in a substantially uniform manner over their entire surface area.

The stretching step c) is preferably performed until an increase in surface area or footage of between 2% and 4% is obtained, depending on the type of wet treatment performed previously.

In a number of practical tests carried out on sheep and goat hides, which had an average thickness of about 1 mm and had been tanned with vegetable tan, an increase in the footage of the hides subjected to the method according to the invention equal to about 4–5% was obtained, compared to the same hides which had not been wet-treated. In the case of chrome-tanned bovine hides of greater thicknesses, having a relative moisture content close to 50%, increases in footage of over 10% were obtained.

It has been established that by acting on hides having a relative moisture content of over 65%, no benefit in terms of increase in footage is achieved, while the difficulties of working on the wet hides increase in an unacceptable manner.

Conveniently, the localised mechanical stresses are exerted on both sides of each hide P at uniformly distributed and substantially equidistant points of their surface extension. Preferably, the mechanical stresses are imparted by means of tools acting on opposite sides of the hides to be stretched so as to produce substantially radial tensions in localised areas centred on said points.

In a preferred embodiment, the mechanical stresses may be performed using a staking machine with beating plates, which have tools acting in directions substantially perpendicular to the plane of extension of the hides and a substantially constant beating frequency, applied to the hides which are fed while being retained on their opposite sides by a pair of mutually facing, annular, conveyor belts.

Preferably, the operating frequency of the staking machine will be between 200 and 1,200 strokes a minute and the feed speed of the conveyor belts is between 2 and 15 m/min.

As shown in schematic form in the left-hand part of FIG. 1, at the end of the wet stretching step c) there follows a step d) involving the intermediate drying and conditioning of the hides in order to reduce their residual relative moisture content to between 25% and 35% so that the hides may still be stretched and pulled easily while remaining relatively flat.

The hides P, still wet, are then conveyed to a further intermediate stretching step e) using procedures similar to those illustrated for step c), although in lower relative humidity conditions, so as to undergo a further increase in footage of between 2% and 5%.

Lastly, the gradually stretched hides are conveyed to the final drying and heat-fixing step f), during which their moisture content falls to a final relative value of between 7% and 15% and their fibres are heat-stressed so as to stabilise their final footage.

In said condition of almost complete dryness, the hides P are subjected to a final stretching step g) aimed at stabilising the hides and giving them the degree of softness and suppleness required by the market.

Following the route along the right-hand side of FIG. 1, the hides P are subjected to two successive cycles of the type described above, as opposed to a single intermediate drying and stretching cycle.

In particular, downstream of the initial stretching step c), the hides P are subjected to a first intermediate drying step $d_1$ until they reach a level of relative moistness of between 30% and 45%, followed by a first intermediate stretching step $e_1$). The hides are then subjected to a second intermediate drying step $d_2$) until they reach a value of relative moistness of between 20% and 30%, followed by a second intermediate stretching step $e_2$.

In this case also the hides P will be conveyed lastly to a final drying stage f) in order to be technically dried almost completely, i.e. to a level of relative moistness of between 7% and 15%.

Lastly, the hides P will be subjected to a final stretching step g) until the footage and degree of softness or "feel" required by the market is obtained.

It should be noted that the wet stretching and gradual stretching allows the effects of the two successive steps to be maximised. Owing to this gradual way of working, increases in footage of up to about 10% may be obtained compared to traditional methods and methods involving wet stretching in a single pass.

Figure 2:
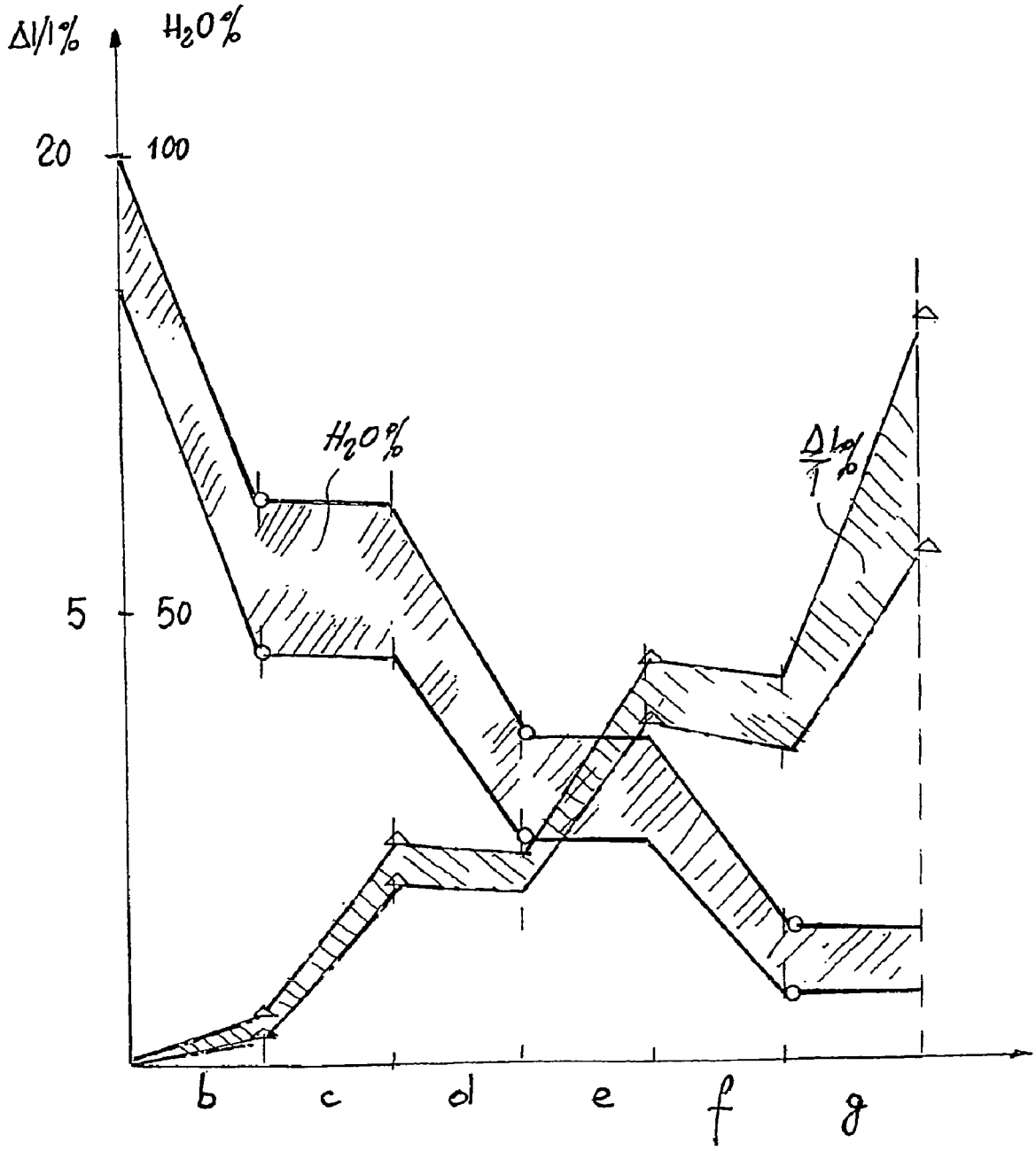
FIG. 2 shows a diagram which illustrates in schematic form the variations in relative moisture content and percentage elongation of the hides during the various steps of the method according to FIG. 1.

The graph according to FIG. 2 illustrates in schematic form the ranges of variation in the relative moisture content of the hides and the relative stretching during the successive steps of the method in the case of a single intermediate partial drying cycle followed by partial wet stretching. The successive steps b), c), d), e), f), g) are shown on the x axes and the maximum and minimum values of relative moisture content $H_2O$ % and percentage elongation $\Delta I/I$ % are shown on the y axes.

FIGS. 3 to 6 illustrate two examples of embodiment of plants for implementing the method according to the invention.

Figure 3:
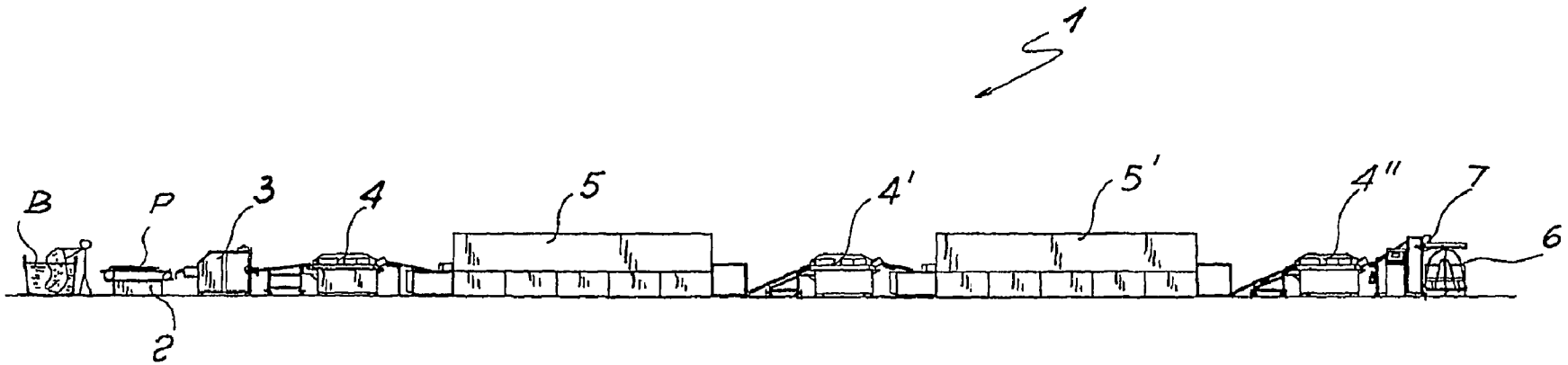
FIG. 3 shows a side view of a first preferred embodiment of a plant for the gradual stretching and drying of hides for implementing the method according to the invention.
Figure 4:
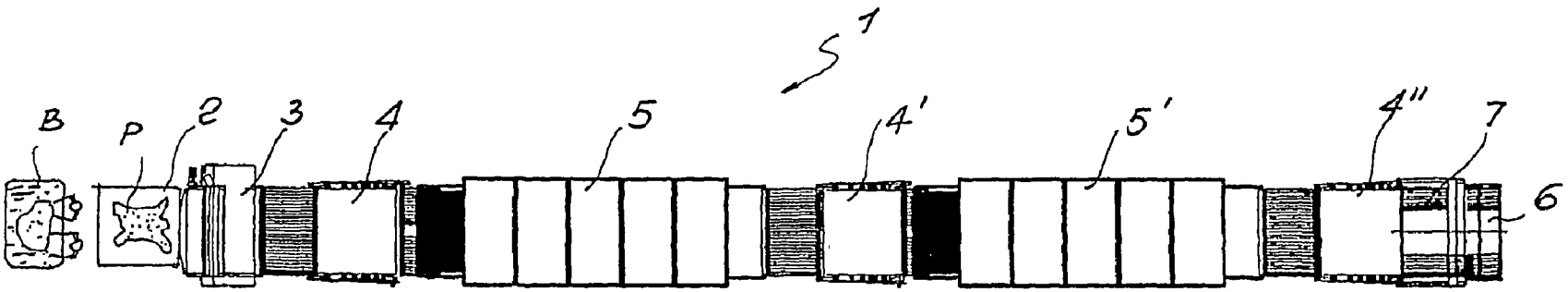
FIG. 4 shows a plan view of the plant according to FIG. 3.

In particular, FIGS. 3 and 4 illustrate a first plant, denoted in its entirety by reference number 1, for implementing the method followed in the left-hand part of the flow chart shown in FIG. 1.

The plant 1 comprises, in sequence, means 2 for removing and feeding the wetted hides P from an apparatus B for treatment with liquids, such as a drum for tanning, retanning, dyeing or the like. In particular, the means 2 may be formed by an automatic feeder or a pair of operators in order to perform step a) of the process.

A drying machine 3 for the initial pressing and predrying of the wetted hides P may be envisaged downstream of the transfer means 2, said machine being intended to perform step b) of the process, reducing the level of relative moistness from a value of between 85% and 100% to a value of between 45% and 65%.

By way of a non-limiting example, the machine 3 may be formed by a wringing/stretching press, model PRC4 RA 3200, produced by the company Bauce of Trissino (Vicenza). The hides P leaving the machine 3 will preferably have a level of relative moistness of between 35% and 65%.

A continuous stretching machine 4, which is intended to carry out step c) of the process—i.e. wet stretching the hides P by means of localised mechanical stresses acting on opposite sides in directions substantially perpendicular to the plane of lie thereof—and is capable of achieving a percentage elongation of between 2% and 4%, may be envisaged downstream of the predrying machine 3.

By way of an example, the machine 4 may be formed by a staking machine with beating plates of the type called Syncro 3200 produced by the present Applicants, in which the hide conveyor belts are made of materials which are waterproof or water-repellent, and in any case non-absorbent, so as to prevent the drainage and impregnation of liquids contained in the hides P being processed.

A device for performing the intermediate step d) of the method is envisaged downstream of the staking machine 4, said device being formed by an intermediate dryer-conditioner 5, for example of the continuous conditioning tunnel type described in international patent WO-A-01/44517 in the name of the present Applicants, and regulated so as to reduce the moisture content to values of between 25% and 30%.

A further intermediate stretching machine, denoted by 4', similar to the staking machine 4 and acting in the same conditions but with a lower level of moistness of the hides P, is located downstream of the conditioner 5, for performing step e) of the method, in order to achieve a percentage elongation of between 2% and 4%.

A continuous drying/conditioning device 5', which is similar to the drying/conditioning device 5 and regulated so as to perform the final drying step f), bringing the relative moisture content of the hides P to a value of between 7% and 15%, is envisaged downstream of the stretching machine 4'.

A stretching or staking device 4" which acts on the almost completely dry hides, for implementing step g) of the process, in order to increase the footage by a further 2–3% and give the hides the degree of softness required by the market, is envisaged downstream of the device 5'.

The hides P are then removed from the staking device 4" and transferred onto a trestle 6 by means of a traditional stacking device 7, for implementing step h) of the method.

The hides treated in this way are characterized by a significant increase in surface area of between 5% and 10% and have a notable quality and softness, without being subject to the mechanical and heat stresses which are typical of traditional methods.

It should be pointed out that the plant for the gradual stretching and drying of industrial hides, for implementing the method described above, may be inserted into a semi-automatic hide-processing line, for example of the type described and claimed in international application WO-A-96/15275 in the name of the present Applicants.

Figure 5:
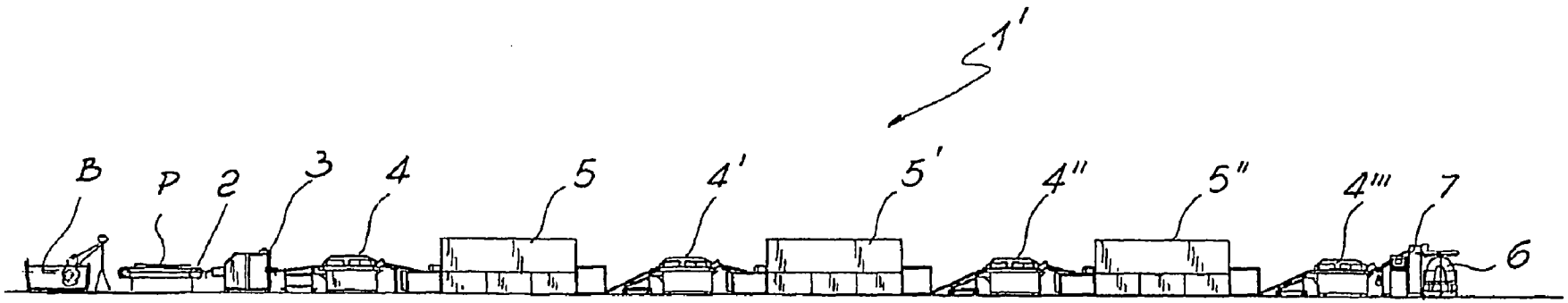
FIG. 5 shows a side view of a second preferred embodiment of a plant for the gradual stretching and drying of hides for implementing the method according to the invention.
Figure 6:
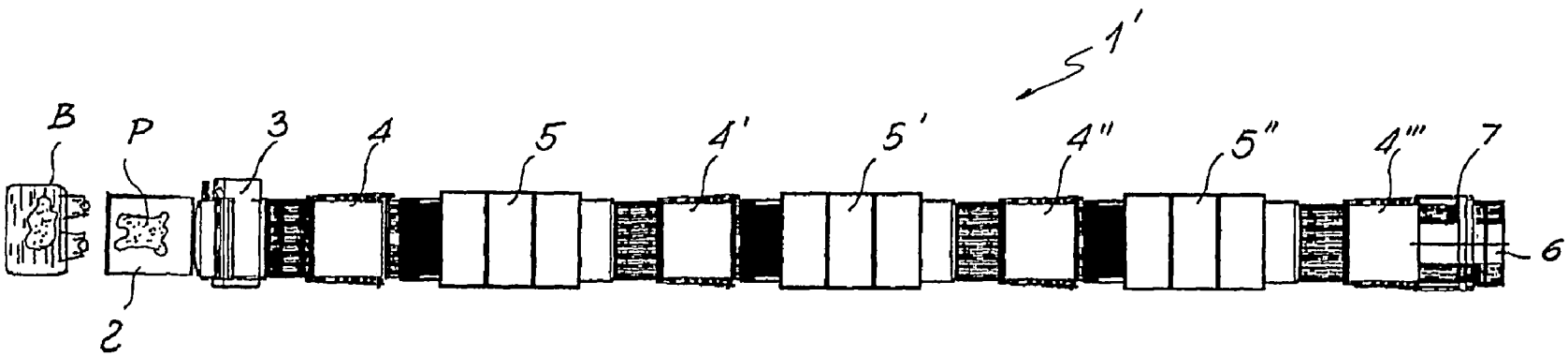
FIG. 6 shows a plan view of the plant according to FIG. 5.

The plant illustrated in FIGS. 5 and 6, denoted in its entirety by reference number 1', differs from that shown in FIGS. 3 and 4 essentially in that it envisages, instead of a single intermediate device, two intermediate partial drying devices, which are denoted by 5, 5' respectively and regulated so as to reduce the relative moisture content to values of between 30% and 45% and 20% and 30%, for implementing steps $d_1$) and $d_2$) of the method, followed by respective intermediate wet stretching devices, denoted by 4', 4" respectively, for implementing steps $e_1$) and $e_2$) of the method according to the invention.

As in the plant according to FIGS. 3 and 4, a final drying device 5" for implementing step f), in order to reduce the relative moisture content to about 7%–15%, and a final stretching device 4'" which acts on the almost completely dry hides, for implementing step g) of the process, resulting in a final percentage elongation of between about 5% and 10%, are located downstream of the intermediate stretching device 4".

Lastly, in the same way as the example according to FIGS. 3 and 4, a stacking device 7, which removes the hides P and deposits them on a trestle 6, for implementing step h) of the method, is envisaged downstream of the stretching device 4'".

It is pointed out that only two operators, for removing the wetted hides P from the drum or tank B and transferring them onto the means 2 for feeding to the press 2, are needed to operate the plant, resulting in a significant reduction in the number of staff and the processing time. Owing to the method and the plant according to the invention, output rates of about 100 hides/hour can be achieved with just two people, compared to the 10 people needed in the past using traditional methods and with lower results in terms of quality.

Assuming an increase in footage of about 7%, it is possible to calculate the benefit in terms of cost-efficiency obtained with the plant and the method according to the invention. In the case of a plant with an output rate of about 100 hides/hour, assuming an average footage of about 50 square feet per hide and a working shift of about 8 hours/day, a total footage of about 40,000 square feet/day and average daily increase of about 2,800 square feet/day is achieved.

Assuming the hides cost an average of about 3.6 Euros/square foot, it is possible to envisage a saving of over 10,080 Euros/day, allowing the cost of a continuous preparation line according to the invention, with a single cycle comprising a predrying machine and a staking device, to be paid off rapidly, i.e. in about 3–4 months.

From the above, it can be understood that the method and the preparation line according to the invention achieve the predetermined objects and, in particular, attention is drawn to the increase in footage with a uniform quality and substantially constant final thickness, without any defects or any risk of damage near the edges of the hide.

The method and the wet preparation line according to the invention may be subject to numerous modifications and variants, all of which fall within the inventive idea described in the accompanying claims.

The instant application is based upon and claims priority of patent application no. VI2002A000050, filed on Mar. 20, 2002 in Italy, the disclosure of which is hereby expressly incorporated here in reference thereto.

The invention claimed is:

1. A method for the continuous gradual stretching and drying of industrial hides and similar products, comprising the steps of:

removing and transfering wet hides supplied following a treatment with liquids, for tanning, or retanning, or dyeing;

predrying of the wet hides until their relative moisture content is reduced to a value of between 45% and 65%;

initial wet stretching and softening of the hides by means of localised mechanical stresses able to recover the loss in footage and softness resulting from the predrying thereof;

at least one intermediate partial drying followed by;

at least one intermediate partial stretching and softening;

final drying of the hides;

final stretching and softening of the completely dried hides;

stacking of the completely dried and softened hides on a suitable support;

wherein said partial stretching steps are carried out on wet hides so as to achieve both a percentage increase in the surface area of between 2% and 4% and an overall total percentage increase of between 5% and 10%.

2. The method according to claim 1, wherein, downstream of said step of initial wet stretching and softening of the hides when wet, a first intermediate partial drying step is performed, followed by a first intermediate partial stretching step, followed by a second intermediate partial drying step, followed by a second intermediate partial stretching step, before proceeding to said final drying step and final stretching and softening of the hides.

3. The method according to claim 1, wherein said step involving the final stretching and softening of the hides takes place in residual relative moisture conditions of between 7% and 15%.

4. The method according to claim 1, wherein the variation in relative moisture following each of said intermediate partial drying steps is between 10% and 40%.

5. The method according to claim 1, wherein said intermediate partial stretching step is performed by means of localised mechanical stresses exerted on the opposite sides of the wet hides at uniformly distributed and substantially equidistant points, without constraining the hides along their edges, and by positioning a pair of substantially impermeable conveyor belts in between so as to keep the hides wet during the staking process.

6. The method according to claim 5, wherein the operating frequency of said staking machine is between 200 and 1,200 strokes a minute and the feed speed of said pair of conveyor belts is between 2 and 15 m/min.

7. A plant for the gradual wet treatment of industrial hides for implementing the method according to claim 1, comprising;

means for removing and transferring the wetted hides from an apparatus for treatment with liquids, such as a drum for tanning, retanning or the like;

a device for the initial partial drying of the wetted hides, regulated so as to reduce the relative moisture content of the hides to a value of between 45% and 65%;

a continuous stretching device for stretching the wet hides by means of localised mechanical stresses which act on opposite sides in directions substantially perpendicular to the plane of lie thereof so as to increase the surface area by a value of between 2% and 4%;

a device for the final continuous drying and heat-setting of the hides, intended to reduce the final relative moisture content of the hides to between 7% and 15%;

wherein, downstream of said initial stretching device, at least one intermediate continuous drying device followed by an intermediate continuous stretching device located upstream of said final drying and heat-fixing device, so as to achieve a total percentage increase in the surface area of the hides between 5% and 10%.

8. A plant according to claim 7, wherein each of said continuous stretching devices is essentially formed by a staking machine with at least one pair of beating plates which are provided with tools and interact periodically with a substantially constant frequency on the wet hides, at least one pair of conveyor belts for the continuous feeding of the hides along their plane of extension being positioned in between.

9. The plant according to claim 7, wherein said pair of continuous conveyor belts are made of impermeable material suitable for keeping the hides in substantially constant moisture conditions.

10. The plant according to claim 9, wherein each of said partial drying devices is formed by a continuous drying and conditioning tunnel with a controlled level of humidity and ventilation.

* * * * *